United States Patent [19]

Gutjahr

[11] 4,044,958

[45] Aug. 30, 1977

[54] EDGE MILL

[75] Inventor: Erwin Gutjahr, Ersingen, Germany

[73] Assignee: Karl Handle & Sohne Maschinenfabrik und Eisengiesserei, Muhlacker, Germany

[21] Appl. No.: 602,654

[22] Filed: Aug. 7, 1975

[30] Foreign Application Priority Data

Aug. 9, 1974 Germany ..... 2438346

[51] Int. Cl.[2] ..... B02C 15/00

[52] U.S. Cl. ..... 241/126

[58] Field of Search ..... 241/103, 110, 114, 120, 241/123, 126, 127, 128, 132, 133

[56] References Cited

U.S. PATENT DOCUMENTS

| | | | |
|---|---|---|---|
| 792,161 | 6/1905 | Pitkin et al. | 241/128 |
| 958,305 | 2/1911 | Van Saun | 241/128 |
| 2,461,176 | 2/1949 | Piper | 241/128 |

*Primary Examiner*—Granville Y. Custer, Jr.
*Attorney, Agent, or Firm*—Walter Becker

[57] ABSTRACT

An edge mill for crushing materials for the manufacture of ceramic articles or the like, in which a cross head is rotatably mounted on a stationarily arranged track column which extends substantially vertically with regard to a substantially horizontally extending grinding track. The cross head is arranged in vertically spaced relationship to the grinding track and above the latter has mounted thereon driver cranks each of which has rotatably arranged thereon a roller-shaped grinding roller for rolling on the grinding track. The grinding rollers are drivingly connected to the driven member of a drive including a driving motor, especially a hydraulic motor. The driving motor is disposed between the grinding rollers on the track column and the member is directly connected to the cross head.

21 Claims, 4 Drawing Figures

EDGE MILL

The present invention relates to an edge mill, for the crushing of materials for the manufacture of ceramic articles or the like, having a grinding track extending approximately horizontally, a cross head located above the track and rotatably mounted on a stationary track axle which extends approximately at a right angle to the grinding track. Driver cranks are mounted on the cross head, and grinding rollers are provided running on the grinding track and rotatably mounted on the cranks. The grinding rollers are drivingly connected to the driven member of a drive having a driving motor, in particular a hydraulic motor.

In edge mills intended for the crushing of ceramic materials, the individual runners or rollers have a considerable weight, for example, 10 tons and more. The grinding runners roll during the operation over the material to be ground whereby because of the comparatively wide contact surface of the grinding runners, a shearing and rubbing action occurs between the grinding runners and the material to be ground. Due to these factors, extremely high mechanical stresses result. A design is known which omits mechanical force transmission elements and the bearing of which and the expensive frame construction necessary therefor is substantially more simple and compact than with conventional mills. With each grinding runner there has been associated a hydraulic motor lying on the axis thereof as a drive means therefor. As a result, however, a number of driving motors corresponding to the number of grinding runners is required; furthermore, for feeding the hydraulic motors, rotating connections are necessary as the hydraulic pump provided therefor is arranged stationary whereas the hydraulic motors with the grinding runners rotate about the axis of the track.

It is, therefore, an object of the present invention to provide an edge mill having a substantially more simple construction and being subjected to less mechanical stress, thereby insuring a high degree of working reliability as well as easy mounting, while nevertheless having the technological advantages of the conventional construction.

These and other objects and advantages of the invention will appear more clearly from the following specification in connection with the accompanying drawings, in which.

Figure 1:
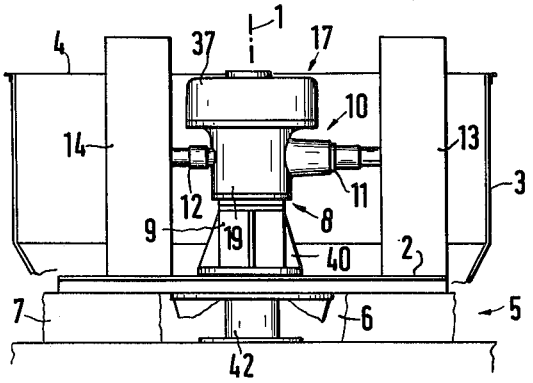
FIG. 1 shows part of one form of an edge mill according to the invention in elevation with the casing therefor cut away.
Figure 2:
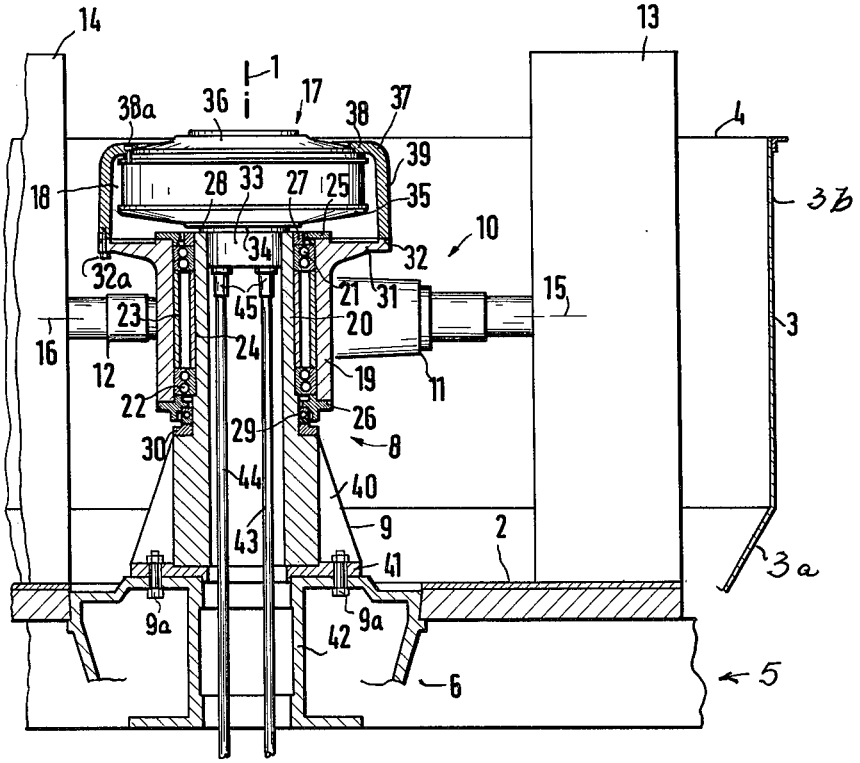
FIG. 2 shows part of the arrangement of FIG. 1 partly in axial section and in an enlarged illustration.
Figure 2A:
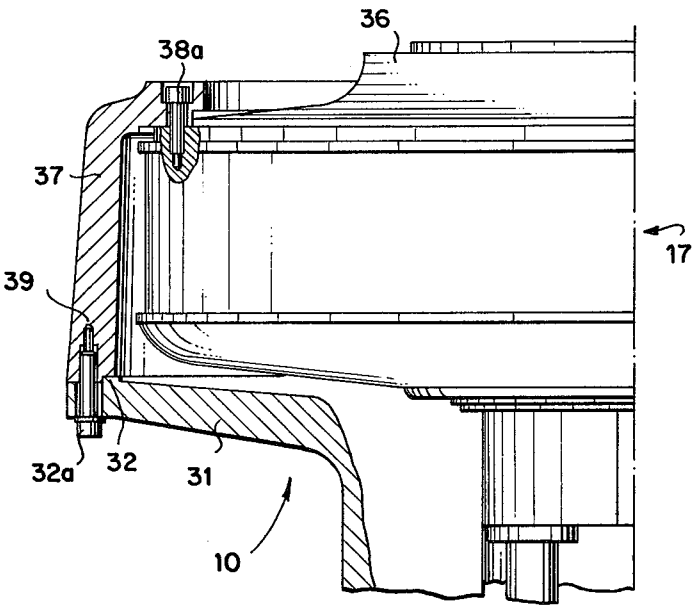
Figure 2A:
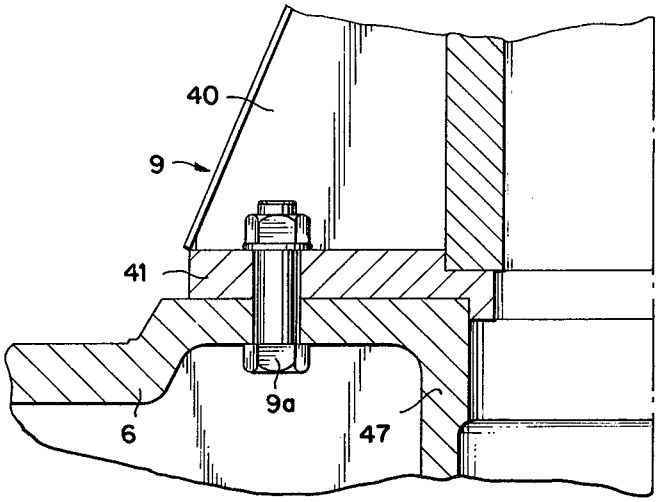

FIGS. 2*a* and 2*A* show further enlarged fragmentary views of structure of FIGS. 1 and 2 of the drawings.

The above objects have been realized by the edge mill according to the invention in which only one driving motor is necessary which is disposed between the grinding runners on the axis of the track, and the driven member of which is connected directly to the cross head. In this way the driving motor is protected and is easily accessible between the grinding runners. The driving transmission from the driving motor to the cross head may be achieved via comparatively short transmission members which may thus be of small dimensions.

Referring now to the drawing in detail, FIGS. 1 and 2 show an edge mill which has an annular disc-like grinding track 2 disposed horizontally around a vertical central axis 1 which is surrounded by a casing 3. Casing 3 has a conical section 3*a* and a cylindrical section 3*b* connected to the conical section extending as far as the horizontal upper edge 4 of casing 3. The grinding track 2 is arranged on a bed or foundation 5, for example, standing on a foundation not shown in detail. The bed has a middle or central part 6 coaxial with the central axis 1 for supporting the inner edge of the grinding track 2 as well as an outer annular part 7 (FIG. 1) on which the grinding track 2 rests along the region of its outer periphery.

Coaxially arranged with the axis 1 there is a track column 8 which has a support section 9 at its lower end by means of which said column 8 is securely fixed by screws 9*a* to the central part 6 of the bed 5 approximately at the level of the grinding track 2. On the upper end of the track column 8 there is mounted a cross head 10 for rotation about the central axis 1. This cross head 10 has two horizontal driver cranks 11, 12 which are connected to the cross head 10. In the embodiment shown, the grinding runners 13, 14 are cylindrical with the same diameters, while their axes 15, 16 extend parallelly to the grinding track 2 and are horizontal. The grinding runners 13, 14 have different radial distances from the central axis 1 so that one grinding runner 13 reaches as far as the outer periphery and the other grinding runner 14 reaches as far as the inner periphery of the grinding track 2.

The grinding runners 13, 14 are driven by a drive 17 which is arranged between the grinding runners 13, 14 and is coaxial with the central axis 1. The drive 17 has a driving motor 18 in the form of a hydraulic motor so that for the drive connection of the driving motor 18 to the cross head 10 a gear is not necessary, in contrast to heretofore designs of the type involved, and the driven member of the driving motor 18 can be directly rotationally connected and locked to the cross head 10.

The cross head 10 in its lower part is a cylindrical bearing sleeve 19 which extends approximately over half the height of the track column 8. At the upper end of the column 8, the bearing sleeve 19 is reduced in diameter and surrounds the outer periphery of the column 8 so that in a simple manner a very secure bearing is possible. In the annular gap between the bearing sleeve 19 and the upper end 20 of the track column 8 there are provided two radial bearings 21, 22 located in axially spaced relationship to each other. These bearings are respectively located in the upper and lower regions of the bearing sleeve 19 while therebetween there are arranged two spacer sleeves 23, 24. One of these sleeves engages the inner periphery of the bearing sleeve 19, and the other sleeve engages the outer periphery of the upper end 20 of the track column 8 so that the outer and inner ring of the radial bearings 21, 22 are held spaced apart from one another. On the upper and lower ends of the bearing sleeve 19 there are respectively fixed annular flanges 25, 26 which are respectively clamped against the appropriate end faces of the bearing sleeve 19 and by means of which the outer race rings of the radial bearings 21, 22 are braced against one another and against the outer spacer sleeve 23. The flange rings 25, 26 are provided with centering projections or centering collars for engaging the bore of the bearing sleeve having a constant diameter over the entire axial extent of the bearing sleeve 19. Connected to the upper end of the track column 8 is a clamping ring 27 by means of which the inner rings of the radial bearings 21, 22 are braced against one another and against the inner spacer sleeve 24. The inner ring of the lower radial bearing 22 is supported by an annular shoulder of the track column 8. The upper end faces of the annular flange 25 and of the clamping ring 27 are located in a common plane as well as in the plane of the upper end face 28 of the track column 8. Directly below the lower flange ring 26 there is provided an axial bearing 29 for the axial supporting of the cross head 10. The upper race ring of bearing 29 rests against this flange ring 26. The lower race ring by way of a further flange ring 30 rests against the annular shoulder of the track column 8. The flange ring 30 has the same diameter as the support section 9 respectively being reduced with outer diameter in respect to the bearing sleeve 19 or having approximately the same outer diameter as an annular collar of the flange ring 26. The flange ring 26 surrounds the axial bearing 29 almost as far as the flange ring 30 so that the axial bearing 29 is protected.

On the upper end, the bearing sleeve 19 has a flange disc 31 formed in one piece therewith. In the region of outer periphery of the flange disc there is an annular collar 32. The drive 17 is connected to the cross head 10 by way of flange disc 31 or bearing sleeve 19 annular collar 32 of the flange disc 31 supporting a cap member 37 secured by screws 32*a*, 38*a* .

The driving motor 18 has on its bottom side a cylindrical element 33 securely fixed thereto and can thus be fixed in a simple manner and securely onto the upper end of the track column 8. The outer cross section of the element 33 corresponds to the cross section of the bore of the track column 8 which is formed as a hollow column so that the drive 17 is accurately aligned in respect of the track column 8. Provided at the upper end of the element 33 is an annular collar 34 having a lower annular shoulder by means of which the drive 17 rests against the upper end face 28 of the track column 8. The element 33 and the annular collar 34 may be designed in one piece with a lower housing part 35 of the driving motor 18. This housing part 35 forms the stationary part of the drive. The driven member 36 of the drive 17 is provided on the upper side of driving motor 18 and is likewise formed by a housing part which upon operation of the mill, rotates relative to the housing part 35. The driven member 36 is drivingly connected to the cross head 10 by way of a cap member 37. This cap member 37 is separable from the driven member 36 and/or from the cross head 10 and from the flange disc 31 so that simple possibilities of mounting result. The cap member 37 formed as a hood has on its upper end an annular disc-shaped section 38 by means of which it surrounds the driven member 36 and is fixed thereto. On the outer periphery, the section 38 merges with a covering section 39 directly downwardly which has its lower end face connected to the upper end of the annular collar 32 by fastening screws 32*a*. By means of the construction described, the cap member 37 surrounds the drive and fastening screws 38*a* hold the section 38 of the cap member 37 relative to the driving motor 18 approximately over the entire height in the form of a housing. The flange disc 31 forms the lower housing wall so that the drive is safely protected.

The support section 9 of the track column 8 has vertical supporting ribs 40 distributed uniformly around the periphery with a centering flange 41 on the upper side of the middle part 6 and is centered in the bore of a central sleeve 42 of the middle part 6 so that with simple mounting an accurate alignment is insured.

The connection pipes 43, 44 for the drive motor 18 are guided by the bore of the track column 8 which has a constant diameter over the entire height of column 8. The upper ends 45 of the connecting pipes 43, 44 which are parallel to one another, are fixed in a simple manner inside the track column 8 on the underside of the element 33. The connecting pipes 43, 44 are guided downwardly by the central sleeve 42 from the bed 5 and in a manner, not shown, are connected to a hydraulic unit which, for example, includes a hydraulic pump driven by means of an electric motor.

Due to the construction described above, the assembly of the mill necessary at the operating place can be substantially simplified. The track column 8 may be screwed onto the bed 5. Furthermore the cap member 37 may be fixed by a screw connection onto the hydraulic motor and onto the cross head.

It is, of course, to be understood that the present invention is, by no means, limited to the specific showing in the drawing but also comprises any modifications within the scope of the appended claims.

I claim:

1. An edge mill for crushing materials for the manufacture of ceramic and similar articles, which includes: a substantially horizontally extending grinding track, a stationary track column extending at least approximately at a right angle and in upward direction through said grinding track, a cross head arranged above and in vertically spaced relationship to said track and being rotatably mounted on said track column, driver crank means mounted on said cross head, grinding roller means rotatably arranged on said crank means, and driving means comprising a driving motor mounted on said column and also comprising a driven member drivingly connected to said cross head.

2. An edge mill according to claim 1, in which said driving motor includes a hydraulic motor.

3. An edge mill according to claim 1, in which a cap member connects said driven member to said cross head.

4. An edge mill according to claim 1, in which said drive motor is an axial alignment with said track column.

5. An edge mill according to claim 1, in which said drive motor is located directly above said driver crank means.

6. An edge mill according to claim 1, in which said driving means is located substantially completely below the level of the top sides of said grinding roller means.

7. An edge mill according to claim 6, which includes casing means surrounding said grinding track and extending up to a level below the top level of said grinding roller means, said driving means at the maximum extending up to the top level of said casing means.

8. An edge mill according to claim 1, in which said driving means is connected to the upper end of said track column.

9. An edge mill according to claim 8, in which said driving means is connected to the upper end of said track column by means of a depending element.

10. An edge mill according to claim 1, in which said track column is designed as a hollow post.

11. An edge mill according to claim 9, in which said depending element is provided at the bottom surface of said driving means and engages the upper end of said track column while being centered thereby.

12. An edge mill according to claim 1, in which said driven member is connected to a driven part of said drive motor located on the top side of said drive motor.

13. An edge mill according to claim 1, which includes a cap member connected to said driven member of said driving means and also connected to said cross head.

14. An edge mill according to claim 13, in which said cap member is designed as a hood at least partially surrounding said driving means.

15. An edge mill according to claim 13, in which said cross head has a bearing sleeve therefor, and which includes a flange disc provided on the upper end of said bearing sleeve, said cap member including a downwardly directed mantle section connecting said cap member to the upper end of said bearing sleeve.

16. An edge mill according to claim 15, in which said cap member includes an annular disc section provided at the upper end of said mantle section, and in which said cap member is connected by means of said annular disc section to said driven member.

17. An edge mill according to claim 15, in which said cross head surrounds the upper end of said track column, and which includes bearing means mounted on said track column and supporting said bearing sleeve.

18. An edge mill according to claim 17, in which the upper end of said track column is reduced in diameter relative to the diameter of the lower section of said track column.

19. An edge mill according to claim 10, which includes fluid conveying feeding lines for said driving motor which extend from below through said hollow track column to said driving means.

20. An edge mill according to claim 19, in which said feeding lines are connected to the bottom side of said depending element.

21. An edge mill according to claim 1, in which said track column has its lower end provided with a support section for detachable connection to a foundation.

* * * * *